US005671842A

United States Patent [19]

Jaworski

[11] Patent Number: 5,671,842

[45] Date of Patent: Sep. 30, 1997

[54] GOLF CLUB BAG WITH RIGID ARMS AND CHAMFERED BASE

[76] Inventor: Ronald P. Jaworski, 832 Pike Rd., West Palm Beach, Fla. 33411

[21] Appl. No.: 587,364

[22] Filed: Jan. 16, 1996

[51] Int. Cl.[6] ..... A63B 55/00; A63B 55/04; A63B 55/08

[52] U.S. Cl. ..... 206/315.3; 206/315.6; 206/315.7; 211/70.2; 224/274; 248/96; 280/DIG. 5; 280/DIG. 6

[58] Field of Search ..... 206/315.2, 315.8; 224/274; 211/70.2; 248/96; 280/DIG. 6, DIG. 5

[56] References Cited

U.S. PATENT DOCUMENTS

| | | | |
|---|---|---|---|
| D. 185,901 | 8/1959 | Parrett . | |
| 1,092,729 | 4/1914 | Low et al. . | |
| 1,116,429 | 11/1914 | Irwin | 206/315.7 X |
| 1,756,902 | 4/1930 | Boyce . | |
| 1,840,663 | 1/1932 | Gallagher . | |
| 2,010,961 | 8/1935 | Reach . | |
| 2,091,298 | 8/1937 | Agnew . | |
| 2,114,870 | 4/1938 | Calkins | 206/315.6 |
| 2,294,084 | 8/1942 | Gihon et al. . | |
| 2,458,924 | 1/1949 | Baker | 280/DIG. 6 X |
| 2,575,930 | 11/1951 | Schwartz | 280/DIG. 6 X |
| 2,685,317 | 8/1954 | Lace et al. . | |
| 2,705,518 | 4/1955 | Burton, Jr. . | |
| 2,722,258 | 11/1955 | Smidt et al. . | |
| 2,760,782 | 8/1956 | Hartzell | 280/37 |
| 2,763,309 | 9/1956 | Jones . | |
| 2,822,969 | 2/1958 | Cooper . | |
| 2,854,244 | 9/1958 | Jarman | 28/DIG. 6 X |
| 2,919,758 | 1/1960 | Newton et al. . | |
| 3,100,048 | 8/1963 | Halverson | 280/DIG. 6 X |
| 3,139,132 | 6/1964 | Shiller . | |
| 3,459,434 | 8/1969 | Dulaney | 280/DIG. 6 X |
| 3,534,735 | 10/1970 | Sly | 128/220 |
| 3,554,255 | 1/1971 | Mangan | 206/315.6 |
| 3,667,078 | 6/1972 | Distasio | 206/315.6 X |
| 3,777,836 | 12/1973 | Riza | 280/DIG. 5 X |
| 3,941,398 | 3/1976 | Nelson | 206/315.6 X |
| 3,996,983 | 12/1976 | Isnardi . | |
| 4,055,207 | 10/1977 | Goodwin . | |
| 4,136,724 | 1/1979 | Leitzel | 206/315.6 |
| 4,200,131 | 4/1980 | Chitwood et al. . | |
| 4,208,227 | 6/1980 | Cowan | 206/315.6 |
| 4,332,283 | 6/1982 | Rader | 206/315.6 |
| 4,852,896 | 8/1989 | Mills | 206/315.3 X |
| 4,911,465 | 3/1990 | Hauer . | |
| 4,930,591 | 6/1990 | Lanius et al. | 280/DIG. 5 X |
| 4,960,212 | 10/1990 | Wa | 211/70.2 |
| 5,042,654 | 8/1991 | Jones | 206/315.7 X |
| 5,069,481 | 12/1991 | Strange | 280/DIG. 5 X |
| 5,094,345 | 3/1992 | Yonnetti | 206/315.6 X |
| 5,168,992 | 12/1992 | Bowdy | 206/315.6 |
| 5,209,350 | 5/1993 | Maeng | 206/315.7 |
| 5,222,598 | 6/1993 | Yamazoe | 206/315.5 |
| 5,228,566 | 7/1993 | Shenoha | 206/315.6 |
| 5,267,660 | 12/1993 | Kwon | 206/315.6 X |
| 5,358,109 | 10/1994 | Nichols | 206/315.3 |
| 5,383,555 | 1/1995 | Weinmeier | 206/315.6 |
| 5,407,155 | 4/1995 | Chung | 206/315.7 X |

FOREIGN PATENT DOCUMENTS

| | | | |
|---|---|---|---|
| 2669234 | 5/1997 | France | 206/315.3 |
| 490428 | 8/1938 | United Kingdom | 206/315.6 |
| 1190570 | 5/1970 | United Kingdom | 280/DIG. 6 X |

*Primary Examiner*—Sue A. Weaver
*Attorney, Agent, or Firm*—Quarles & Brady

[57] ABSTRACT

The golf club bag includes an elongated hollow bag body having an outer skin surrounding a central axis. A rigid base is provided for enclosing a lower end of the bag body. One or more rigid arm members are mounted to an upper portion of the bag body opposite from the lower end and securing structure is provided on a portion of the arm members spacedly offset from the bag body. The rigid arm members are attached to the bag body by means of a pivot joint for permitting the rigid arm members to pivot about a pivot axis, the pivot axis being transverse to the bag central axis. The bag has a rigid base which includes a chamfer formed thereon. The chamfer provides a stable support surface for maintaining the bag in a stationery position with the central axis offset from a vertical orientation.

16 Claims, 7 Drawing Sheets

GOLF CLUB BAG WITH RIGID ARMS AND CHAMFERED BASE

BACKGROUND OF THE INVENTION

Conventional golf club bags suffer from several common problems when they are used in conjunction with a golf cart. Typical golf carts are equipped with a storage area at a rearward portion for holding a plurality of golf club bags. These storage areas generally provide a low deck area, approximately 10 inches above ground level, upon which one or more golf bags may be placed. Further, a support bar is usually provided across a portion of an upper cart deck adjacent to the low deck area. The support bar typically is provided with straps which may be used by golfers to secure their golf club bags in position while the cart is moving across a golf course. In this manner, the golf club bags and the clubs contained therein are maintained in a roughly vertical orientation.

Positioning the bags in this vertical orientation makes it difficult for players to select and retrieve clubs contained therein. This is particularly true for players who are below average height, or for women, who commonly are not as tall as male golfers. Typical golf club bags are approximately 35" in height and, when vertically positioned in a golf cart, the top of the bag is approximately 45 to 47 inches above the ground. Accordingly, golf clubs contained within the bag must be raised at least that high in order to remove them from the bag.

Another difficulty associated with golf club bags concerns keeping golf clubs organized therein. Various racks have been proposed which attempt to solve this problem. See, e.g. U.S. Pat. Nos. 4,208,227 and 2,722,258. Such racks, however, suffer from a common problem relating to the variability of golf club length, particularly as between men's and women's clubs. Club lengths for equivalent men's and women's clubs may vary as much as 4 inches. Consequently, a bag suitable for women's golf clubs may not be suitable for men's golf clubs and vice versa.

It is an object of this invention to provide a golf club bag having improved features to facilitate selection and retrieval of golf clubs retained therein when the bag is positioned on a golf cart. Another object is to maintain the clubs contained therein in an orderly fashion so that golf clubs of any length may be easily stored and located. Another object is to facilitate removal of clubs from a golf club bag stored upon a golf cart by preventing entanglement of club shafts and grips.

SUMMARY OF THE INVENTION

In accordance with one aspect of the invention there is provided a golf club bag adapted for use with a golf cart. The golf club bag includes an elongated hollow bag body having an outer skin surrounding a central axis. A rigid base is provided for enclosing a lower end of the bag body. One or more rigid arm members are mounted to an upper portion of the bag body opposite from the lower end, and securing structure is provided on a portion of the arm members spacedly offset from the bag body. The rigid arm members are preferably attached to the bag body by means of a pivot joint for permitting the rigid arm members to pivot about a pivot axis, the pivot axis being transverse to the bag central axis. According to the invention, the pivot joint may be permanently mounted on a structurally reinforced portion of said golf club bag to limit movement of said bag to a direction transverse to the pivot axis. Alternatively, the pivot joint can be mounted to the upper portion of the golf club bag by means of a removable clamp. In the case where a single rigid arm member is attached to the bag, it is preferably provided with a pair of swing arms at its distal end for added stability. For a single rigid arm member attached to the bag by means of a clamp, the clamp is preferably provided with a clamping surface forming an acute angle with the rigid arm members.

The securing means may advantageously be comprised of a J-hook for permitting convenient engagement of a rigid mounting bar on a golf club cart. However, the invention is not so limited and other means for attaching the rigid support arms to the mounting bar may also be used. The J-hook is preferably provided with an adjustable locking block for maintaining the J-hook in a stationary position on the mounting bar. The locking block is preferably mounted on a threaded shaft fitted into a guide channel along a portion of the length of the rigid support arm. A wing nut or other suitable means is provided for engaging the threaded shaft and thereby maintaining the locking block in position. The securing J-hooks or other securing structure are positioned on a portion of said rigid arm members spacedly offset from said pivot axis by a distance at least sufficient to cause said central axis to be offset from a vertical orientation by an angle of approximately 5 degrees.

With the bag so designed, the bag body may be advantageously retained in a golf cart with its central axis offset from a vertical orientation and its upper portion angled away from the interior of the cart. The golf club bag according to the invention may be formed with a standard flat surface base which is common among golf bags of the prior art. Alternatively, however, the bag may have a rigid base which includes a chamfer formed on a lower periphery thereof. The chamfer provides a stable support surface for maintaining the bag in a stationery position with the central axis offset from a vertical orientation. If a chamfer is used, its surface area is preferably between 10% and 25% of the entire surface area of the downwardly facing surface of the rigid base, to ensure stability when the bag is positioned in a vertical and a tilted orientation. Further, friction strips may be provided on the surface area of said chamfer to avoid slippage. The friction strips are preferably formed from a material having a coefficient of friction substantially higher than that of the material of the chamfer surface.

The golf bag according to the invention is advantageously designed for use with a golf cart. However, the invention may also be used in other ways as well. For example, the Cart bag may be provided with a shoulder strap or handle, of the kind which are well known in the art, to permit the bag to be carried by a walking golfer. Alternatively, the bag may be mounted on a hand pulled cart. For such purposes, a U-shaped stand may be provided, pivotally attached to the cart, for helping to support the bag in a tilted position when on the driving range, for example.

As an alternative to a chamfered base integrally formed with the golf bag as described above, the bag according to the invention may utilize an auxiliary base which may be attached to said golf club bag at its lower end by means of a strap or other suitable attaching mechanism. The auxiliary base is formed so as to define a support surface positioned at an acute angle relative to the bag central axis. The purpose of the auxiliary base is to provide a stable surface for the bottom of the golf bag to rest upon when under circumstances where a club bag was not originally manufactured with a chamfered base.

In a more specific aspect according to the invention, the golf club bag may be provided with a molded upper cap plate having club apertures defined therein for receiving the handles and shafts of golf clubs to be carried in the bag. One or more rack members with a series of notches formed on a first edge thereof for receiving a plurality of golf club heads is also provided. The rack members have at least one tongue member protruding in a direction downwardly away from the notches formed thereon. A corresponding receiving member is formed in the molded upper cap plate for slidably receiving the tongue of the one or more rack members. When formed in this manner, the rack members may be slidably adjusted relative to the molded upper plate to accommodate golf clubs having shafts of various lengths. A set screw is provided in each tongue receiving member and a slot is defined along the length of each tongue. The set screw permits relative sliding movement of the rack when the screw is rotated to an adjustment position and prevents such movement when tightened to a locking position.

BRIEF DESCRIPTION OF THE DRAWINGS

Having thus briefly described the invention, the same will become better understood from the following detailed discussion, read in conjunction with the drawings wherein.

DETAILED DISCUSSION OF THE INVENTION

Figure 1:
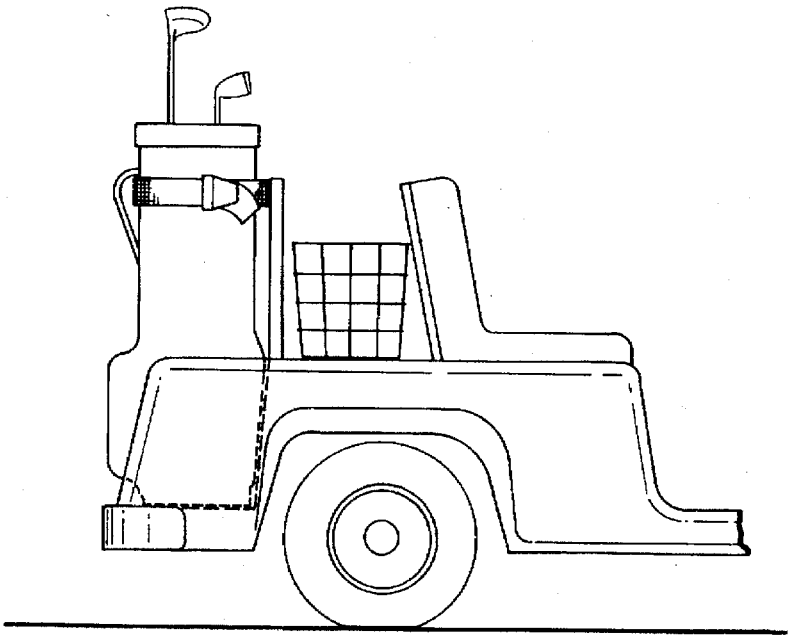
FIG. 1 (PRIOR ART)
FIG. 1 is a side elevation view showing a golf club bag of the prior art positioned in a golf cart.
Figure 2:
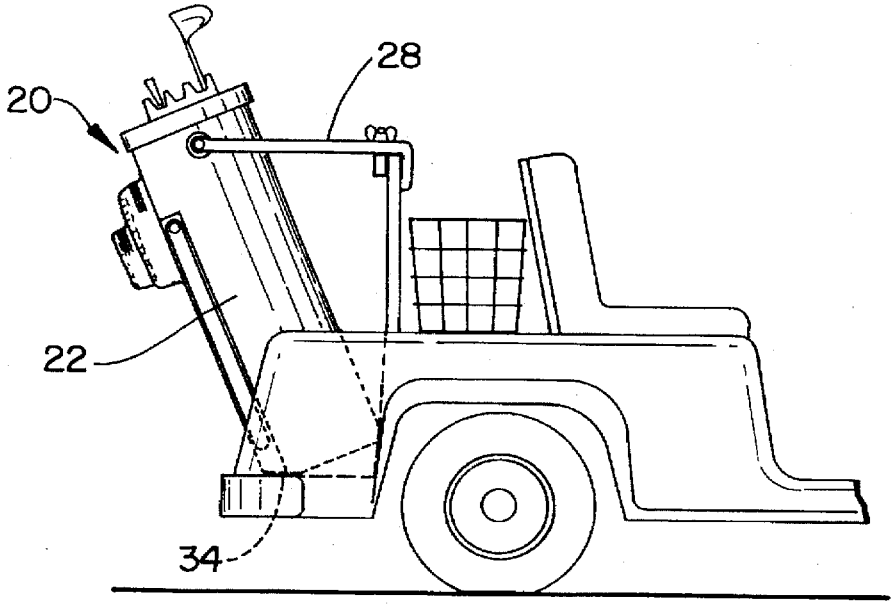
FIG. 2 is a side elevation view showing a golf club bag according to the invention, positioned within a golf cart.

FIG. 1 illustrates a golf club bag of the prior art positioned in a typical golf cart. As may be seen from FIG. 1, the golf club bag is positioned in a substantially vertical orientation and spaced off the ground. FIG. 2 shows a golf club bag 20 according to the present invention, positioned in a golf cart.

As shown in FIGS. 2–8, the golf club bag 20 according to the present invention, includes an elongated hollow bag body 22 having an outer skin 24 surrounding a central axis. The central axis is defined as passing longitudinally through the center of the bag body. A rigid base 26 is provided for enclosing a lower end of the bag body 22. One or more rigid arm members 28 are mounted to an upper portion of the bag body 22 opposite from the lower end and securing hooks are provided on a portion of the arm members 28, spacedly offset from the bag body 22. The rigid arm members 28 are preferably attached to the bag body 22 by means of a pivot joint 32 for permitting the rigid arm members 28 to pivot about a pivot axis, the pivot axis being transverse to the bag central axis. For the purposes of this specification, it should be understood that reference numeral 20 refers to a golf club bag system, including, for example, rigid arm members 28 and other accessory structures. By comparison, reference numeral 22 is intended to refer more particularly to a "bag body", i.e. the combination of outer skin 24, and rigid base 26.

The golf club bag 20 may be manufactured in accordance with any of several well known methods to those of ordinary skill in the art for forming bag bodies. For example, the outer skin 22 may be formed as a hard plastic shell or may be formed from heavy gauge natural or synthetic cloth materials which are internally framed or braced for rigidity. The golf club bag preferably has the shape shown in FIGS. 3–5. However, the invention is not so limited and the bag may also be formed in other oblong cylindrical or rectangular shapes.

Figure 3:
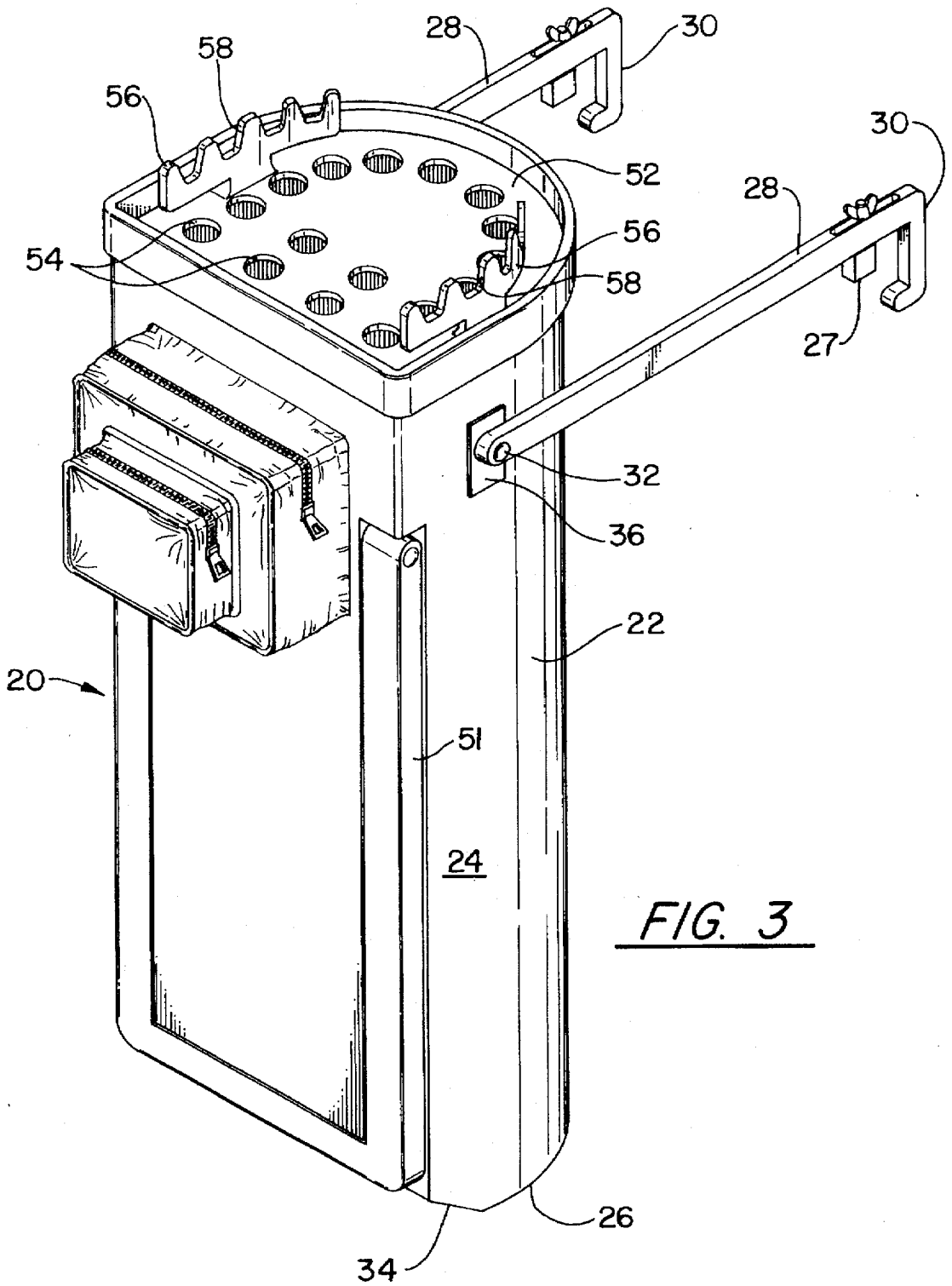
FIG. 3 is a perspective view of a golf club bag according to the invention.

Rigid arm members 28 are preferably formed of a lightweight metal material for strength, but may also be formed from any other suitable rigid material such as a fiber reinforced plastic. As shown in FIG. 3, the pivot joint 32 may be economically provided by means of a pivot bolt passing through an aperture in a structurally reinforced area of the outer skin 24. However, the invention is not so limited and any suitable pivot mechanism may be used for this purpose.

Figure 6:
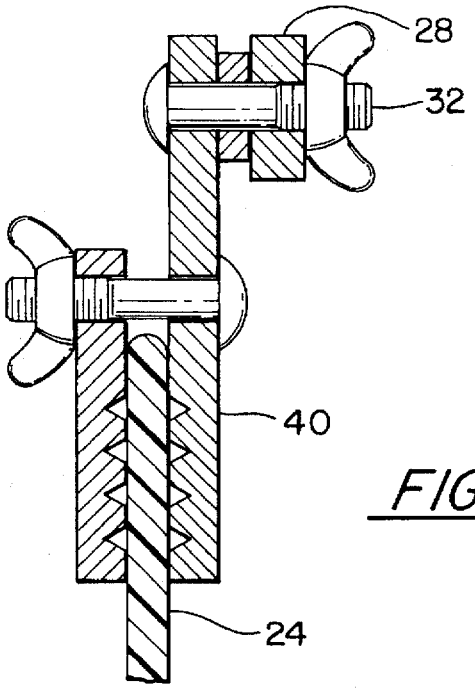
FIG. 6 is a cross-sectional view of a rigid arm member according to the invention, mounted on an upper portion of a golf club bag by means of a removable clamp.
Figure 7:
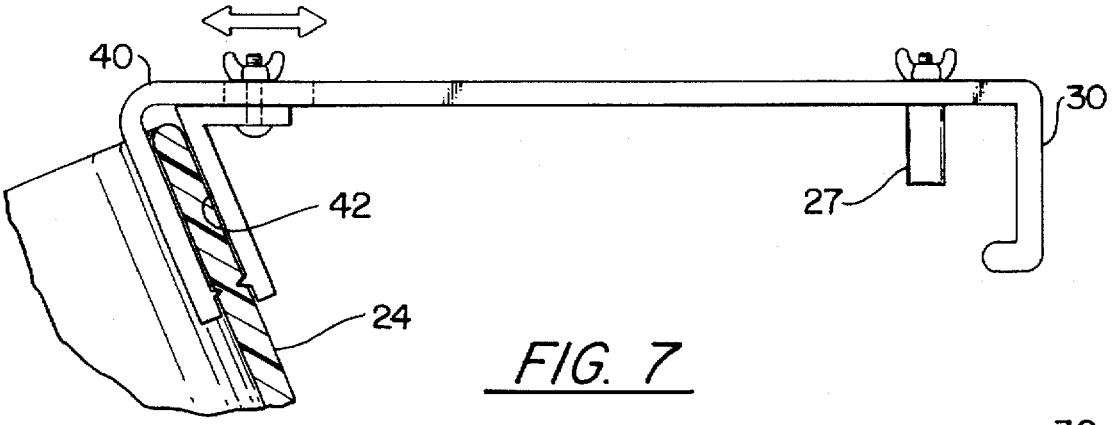
FIG. 7 is a side elevation view of a rigid arm member having an adjustable clamp, mounted to a golf club bag.

According to the invention, the pivot joint 32 may be permanently mounted on a structurally reinforced portion 36 of golf club bag 20, as shown in FIG. 3. Alternatively, however, the pivot joint 32 can be mounted to the upper portion of the golf club bag 20 by means of a clamp 40, as shown in FIGS. 6, 7 and 8. When used in such manner, the clamp 40 may be attached to the outer skin of the golf club bag 42 as shown in FIGS. 6 and 7, or to some other suitable portion of the golf club bag 20. FIGS. 6 and 7, show two possible clamp mechanisms 40 for securing the rigid arms to the golf club bag 20. It should be noted however that alternative clamp mechanisms may also be used and the invention is not limited in this regard.

As shown in FIG. 7, in the case of a single rigid arm member 28 attached to the bag 20 by means of a clamp 40, the clamp is preferably provided with a clamping surface forming an acute angle with the rigid arm members. This orientation of the clamp surface facilitates proper orientation of the bag in its tilted position when the bag is positioned within a golf cart.

Figure 8A:
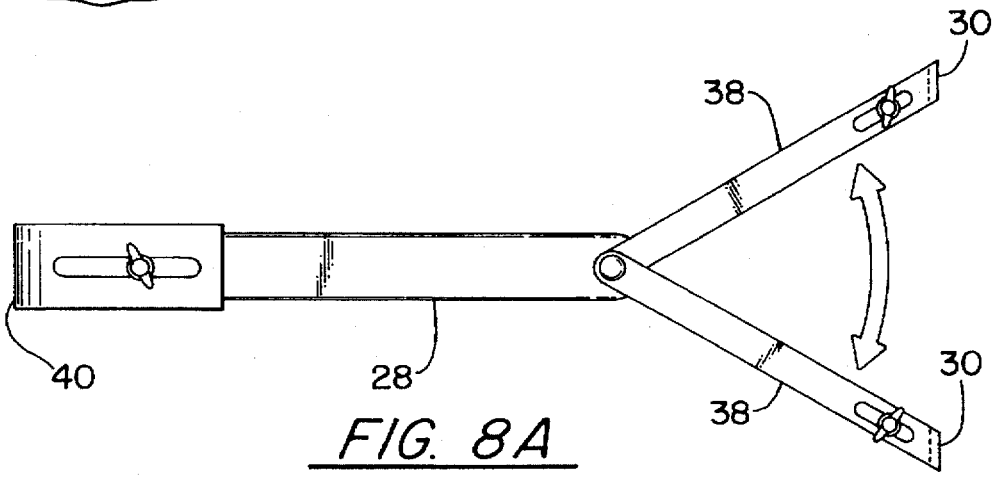
FIG. 8(A) is a top view of an alternative version of a rigid arm member having a pair of swing arms at its distal end for added stability.

As shown in FIGS. 8(A) and (C), in those cases where a single rigid arm member 28 is attached to the bag 20, it is preferably provided with a pair of swing arms 38 at its distal end for added stability when attached to a golf cart. The swing arms 38 are secured to the rigid arm members 28 by means of a pivot bolt 29 so as to permit them to swing outwardly from one another. By swinging out from one another, the swing arms 38 enhance the lateral support of the rigid arm 28 against the golf cart securing rod or bracket.

Figure 8B:
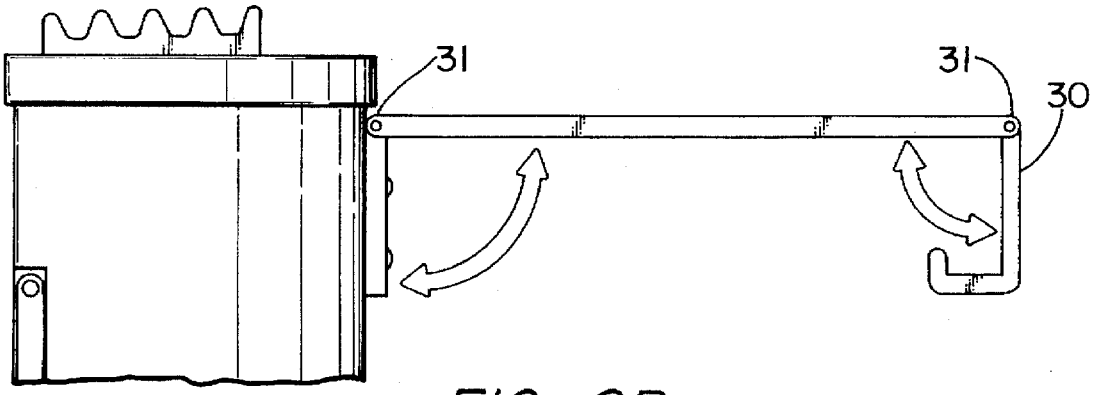
FIG. 8(B) is a side view of an alternative version of a rigid arm member having foldable sections.
Figure 8C:
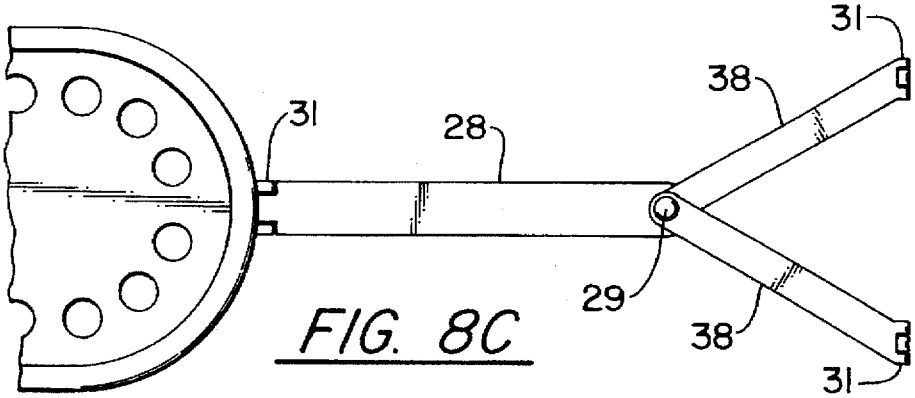
FIG. 8(C) is a top view of an alternative version of a rigid arm member having a pair of swing arms hingedly attached to a main arm portion.

The securing hooks 30 may advantageously be comprised of a J-hook as shown in FIGS. 2–4, 7 and 8(A)–(C). When formed in this manner the securing hooks 30 permit convenient engagement with a rigid mounting bar on a golf club cart as shown in FIG. 2. However, the invention is not so limited and other means for attaching the rigid support arms 28 to a golf cart mounting bar may also be used. If J-hooks are used, they are preferably provided with locking blocks 27 which are designed to be slidably adjustable along a portion of the length of the rigid support arms within a channel or other suitable guide structure formed therein. The locking blocks are provided to allow the J-hook to be securely positioned on a golf cart rigid mounting bar. As shown if FIGS. 8(B)–(C), the rigid arm may be formed with hinges 31 to permit a range of motion as shown in FIG. 8(B). In this way, the rigid arm may be partially folded for convenience in storage and traveling.

The securing hooks 30 or other securing structure are positioned spacedly offset from said pivot axis by a distance sufficient to allow the bag central axis to be offset from a vertical orientation by an angle of at least 5 degrees, when the securing hooks are positioned on a golf cart mounting bar.

With the bag so designed, the bag body 20 may be advantageously retained in a golf cart with its central axis offset from a vertical orientation and its upper portion angled away from the interior of the cart. Positioning the bag in such manner facilitates removal of golf clubs retained therein by lowering the top of the bag from between 1 and 4 inches.

The golf club bag 20 according to the invention may be formed with a standard flat surface base which is common among golf bags of the prior art. See FIG. 1. In a preferred embodiment however, the bag 20 may have a rigid base 26 which includes a chamfer 34 formed on a portion thereof. The chamfer 34 provides a stable support surface for maintaining the bag in a stationery position in a golf cart, with the bag central axis offset from a vertical orientation. If chamfer 34 is used, its surface area is preferably between 10% and 25% of the entire surface area of the downwardly facing surface of the rigid base 26. This ensures good stability of the bag 20 when it is positioned in a vertical and a tilted orientation. Further, friction strips 44 may be provided on the face of the chamfer 34 in order to avoid slippage when the bag is positioned in its inclined position. The friction strips 44 are preferably formed from a material having a coefficient of friction substantially higher than that of the material of the chamfer surface.

Figure 9:
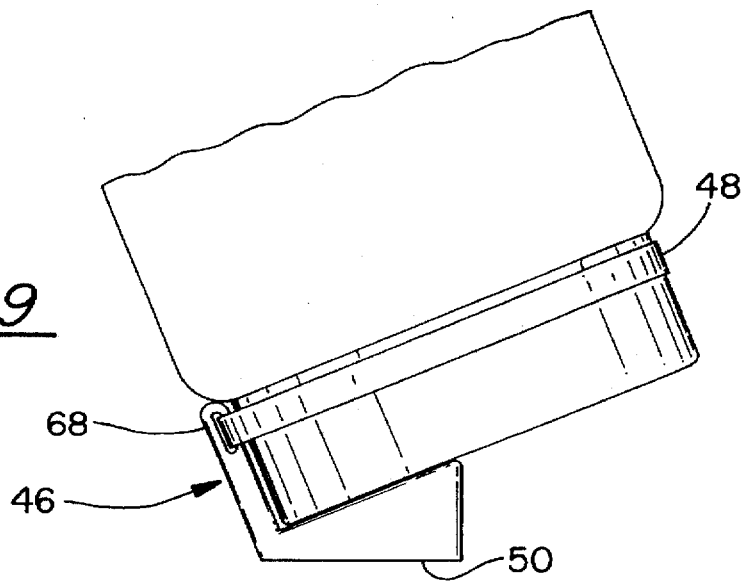
FIG. 9 is a perspective view of an auxiliary base attached to a golf bag for providing added stability to a golf club bag.

As an alternative to chamfer 34 integrally formed with the golf bag 20 as described above, the bag according to the invention may utilize an auxiliary base 46, as shown in FIG. 9. Auxiliary base 46 may be attached to golf club bag 20 at its lower end by means of an adjustable strap 48, or other suitable attaching mechanism. As shown in FIG. 9, the auxiliary base 46 is formed so as to define a support surface 50 positioned at an acute angle relative to the bag central axis. Further, the auxiliary base may be provided with a support lip 68. Support lip 68 is provided to assist in maintaining a golf bag in position on the auxiliary base 46. Auxiliary base 50 is especially advantageous for providing a stable surface for the bottom of a golf bag 20 to rest upon under circumstances where the club bag has not been originally manufactured with a chamfered base.

The golf bag 20 may be provided with a shoulder strap or handle (not shown), of the kind which are well known in the art, to permit the bag to be carried by a walking golfer. Alternatively, or in addition, the bag may be mounted on a hand pulled cart. A U-shaped stand 51 is preferably provided mounted on golf club bag 20. The stand 51 is pivotally attached to the cart, for helping to support the bag in a tilted position when the bag is not on a golf cart. See FIG. 4.

Figure 5:
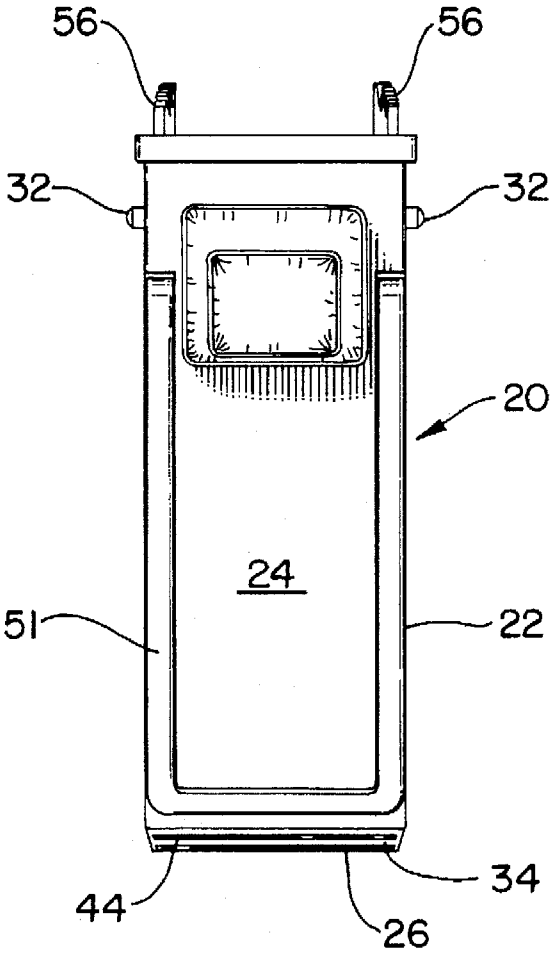
FIG. 5 is a rear view of the golf club bag in FIG. 3.
Figure 4:
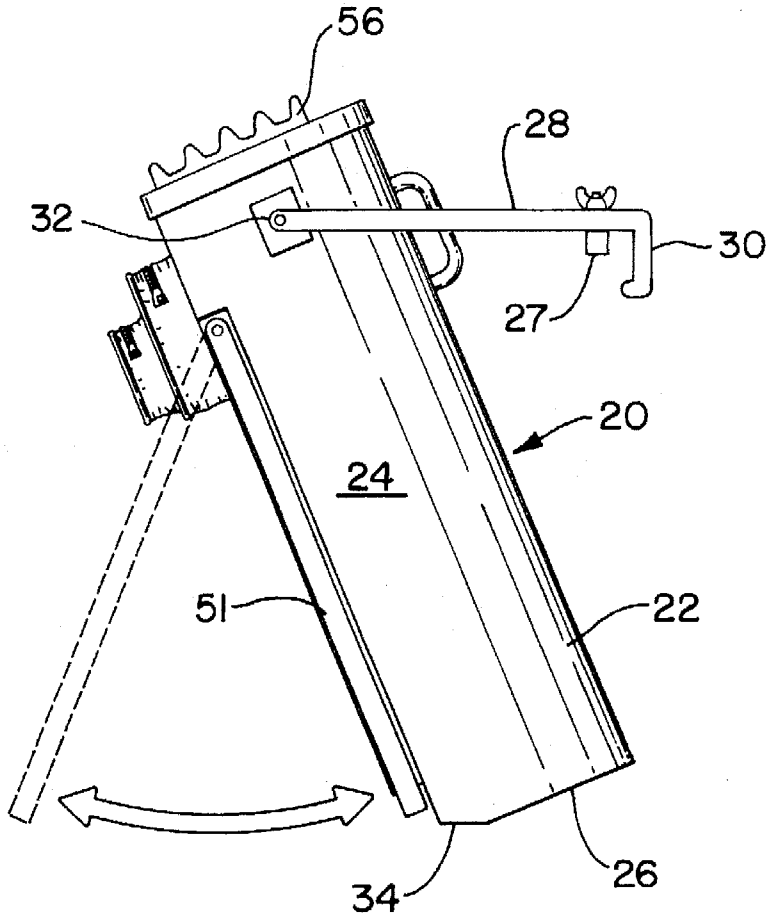
FIG. 4 is a side view of the golf club bag in FIG. 3.

In a further aspect according to the invention shown in FIGS. 3–5, the golf club bag 20 may be provided with a molded cap plate 52 having club apertures 54 defined therein for receiving the handles and shafts of golf clubs to be carried in the bag. One or more rack members 56 are also provided with a series of notches 58 formed on an upper edge thereof. The rack members 56 are provided for receiving and retaining therein a plurality of golf club heads.

Figure 10:
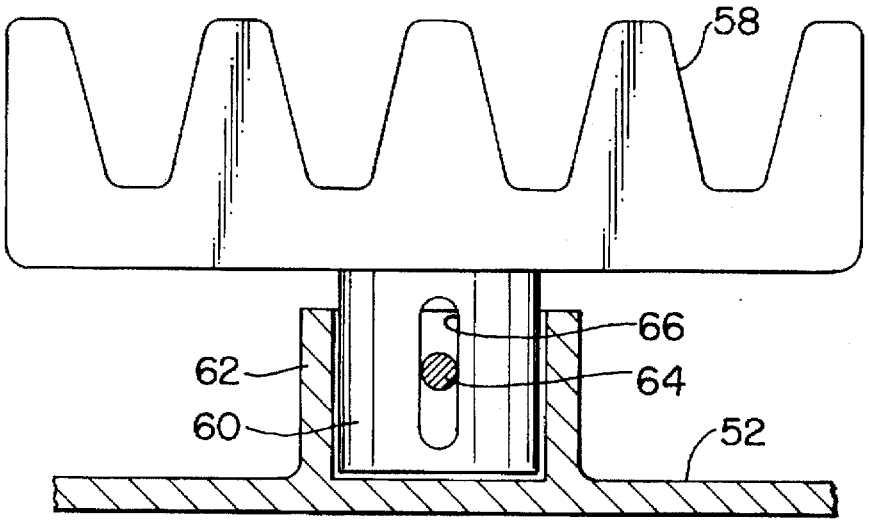
FIG. 10 is a sectional view of a slidably adjustable rack member inserted in the upper cap plate according to the invention.

As shown in FIG. 10, the rack members 56 have at least one tongue 60 protruding in a direction downwardly away from the notches 58 formed on the rack. A corresponding receiving member 62 is formed in the molded cap plate 52 for slidably receiving the tongue 60 of each rack member 56. When formed in this manner, the rack members 56 may be slidably adjusted relative to the molded cap plate 52 to accommodate golf clubs having shafts of various lengths.

In an alternative embodiment, each rack member 56 may be formed with only a single notch 58 for receiving a single club head. Thus, rack members 56 may be individually adjusted to accommodate any combination of golf club shaft lengths.

Regardless of the number of notches 58 provided on each rack member 56, a locking mechanism is provided in each tongue receiving member 62 for securing the rack member 56 in a desired position. In FIG. 10, the locking mechanism is comprised of a set screw 64 threaded in the wall of each tongue receiving member 62 and a slot 66 is defined along a portion of the length of each tongue 60. The set screw 64 permits relative sliding movement of the rack 56 when the screw is rotated to a loosened adjustment position and prevents such movement when tightened to a locking position. Significantly, the set screw arrangement represents only one possible means for locking the rack member 56 in position, and any other suitable locking mechanism may be used for this purpose.

Figure 11:
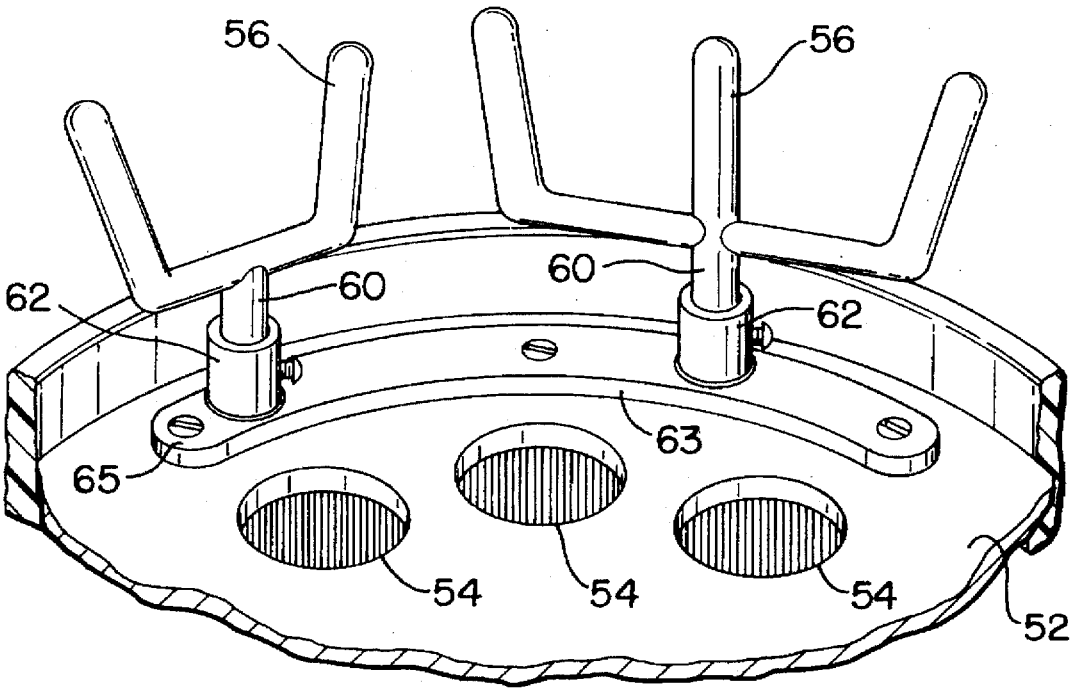
FIG. 11 is a perspective view of a portion of an accessory for a molded cap plate according to the invention, with slidably adjustable rack members.

Finally, in a further alternative embodiment shown in FIG. 11, the adjustable rack system may be provided as an accessory system for conventional molded cap plates. In FIG. 11, reference numbers correspond to the description previously set forth with respect to FIG. 10. As shown in FIG. 11, however, the receiving members 62 are formed on a mounting plate 63, which may be attached to a conventional golf club bag cap plate 52 by suitable means such as screws 65, or plastic cement. As shown in FIG. 11, a single notch rack member 56 may be used or a double notch rack member positioned between adjacent club apertures 54.

Figure 12:
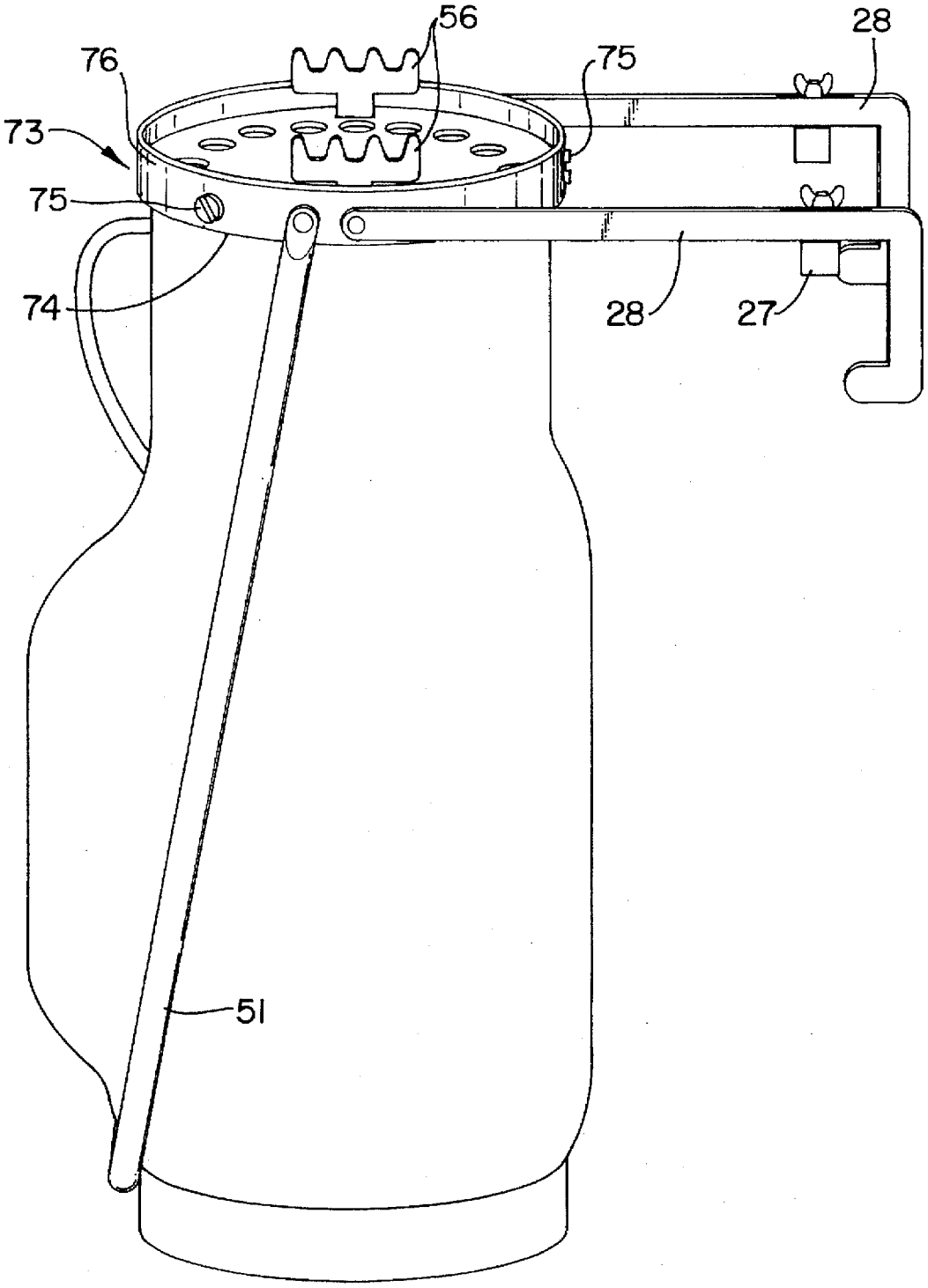
FIG. 12 is a perspective view of a retrofit cap for a golf bag according to the present invention.

In a further specific embodiment according to the invention, a retrofit system is provided which incorporates one or more of the features of the invention as recited above. As shown in FIG. 12, the system is designed as a retrofit cap 73 to be fitted on standard cylindrically shaped golf bags. The cap 73 is formed with a receiving channel 74 which engages the upper periphery of an existing golf bag as shown. One or more holding screws 75 are provided for securing the cap 73 to the existing bag. For the purposes of the retrofit system, rigid arm members 28 are preferably pivotally mounted to the side walls 76 of the cap. Rack members 56 may be mounted on the cap as described above. Similarly, a U-shaped stand 51 may be provided for stabilizing the bag when it is not positioned within a golf cart.

Although particular preferred embodiments of the invention have been disclosed in detail for illustrative purposes, it will be recognized that variations or modifications of the disclosed invention including alternative clamping means, various manner of securing structure, and alternative chamfer structures lie within the scope of the present invention.

What is claimed is:

1. A golf club bag adapted for use with a golf cart vehicle, of the kind having a rigid mounting bar for receiving a golf club bag in a substantially vertical orientation on said golf cart vehicle, said golf club bag comprising:

an elongated hollow bag body having an outer skin and defining a central, longitudinal axis;

a rigid base enclosing a lower end of said bag body;

at least one elongated, rigid arm member mounted to an upper portion of said bag body opposite from said lower end; and, securing means disposed on a portion of said at least one arm member spaced from said bag body and engageable with said rigid mounting bar on said golf cart vehicle, said bag body being retained in said golf cart vehicle with said central longitudinal axis tilted away from said substantially vertical orientation of said rigid mounting bar and said upper portion of said bag body spaced away from said rigid mounting bar on said golf cart vehicle and positioned closer to ground level.

2. The golf club bag according to claim 1, further comprising a pivot joint for attaching said at least one rigid arm member to said bag body, said pivot joint having a pivot axis transverse to said central longitudinal axis.

3. The golf club bag according to claim 2, wherein said bag body comprises a structurally reinforced portion for receiving said pivot joint and limiting movement of said bag body to a direction transverse to said pivot axis.

4. The golf club bag according to claim 2 wherein said pivot joint comprises a removable clamp for attachment to said upper portion of said bag body.

5. The golf club bag according to claim 1 wherein said securing means comprises a J-shaped hook for engaging said rigid mounting bar on said golf cart vehicle.

6. The golf club bag according to claim 1, wherein said securing means are positioned on a portion of said at least one rigid arm member spaced from said bag body by a distance at least sufficient to cause said central longitudinal axis to be tilted away from said substantially vertical orientation of said rigid mounting bar by an angle of at least approximately 5 degrees.

7. The golf club bag according to claim 1, wherein said rigid base includes a chamfer formed on a lower periphery thereof, said chamfer providing a stable support surface for maintaining said bag body in said tilted away position with said upper portion of said bag body spaced away from said golf cart vehicle.

8. The golf club bag according to claim 7, wherein the surface area of said chamfer is between approximately 10% and 25% of the entire surface area of said rigid base.

9. The golf club bag according to claim 8, further comprising friction enhancing means provided on said surface area of said chamfer to reduce slippage.

10. The golf club bag according to claim 1, further comprising:

an auxiliary base adapted for attachment to said golf club bag at said lower end;

a rigid L shaped member having first and second portions;

said first portion providing means for attaching said auxiliary base to said golf club bag; and, said second portion defining a support surface formed at an acute angle relative to said central longitudinal axis for maintaining said bag body in said tilted away position with said upper portion of said bag body spaced away from said golf cart vehicle.

11. The golf club bag according to claim 1 further comprising:

a molded upper plate having club apertures defined therein for receiving the handles and shafts of golf clubs to be carried in said bag;

at least one rack member having a first edge with at least one notch formed on said first edge for receiving at least one golf club head, said at least one rack member being provided with at least one tongue protruding in a direction downwardly away from said notches; and, at least one receiving member channel formed in said molded upper plate for slidably engaging said at least one tongue of said at least one rack member, said receiving member channel having a cross-sectional profile matched to said tongue so that said tongue closely interfits therein, the position of said at least one rack member being slidably adjustable relative to said molded upper plate to accommodate golf clubs having shafts of various lengths.

12. The golf club bag according to claim 11 further comprising:

a set screw positioned in said at least one receiving member channel; and, said at least one tongue having a longitudinal slot, said set screw passing through said slot and permitting relative sliding movement of said rack member when positioned in an adjustment position and preventing such movement when tightened to a locking position.

13. The golf club bag according to claim 1, comprising:

a molded cap member secured to said upper portion of said bag body; and, said at least one elongated, rigid arm member mounted to said cap member.

14. A golf club bag accessory for mounting on a golf club bag having an elongated hollow bag body, a central longitudinal axis and a base enclosing a lower end of said bag body, said golf club bag accessory comprising:

at least one elongated rigid arm member mounted to a pivot joint for permitting said at least one rigid arm member to pivot about a pivot axis, said pivot joint attached to a clamp; and, securing means on a portion of said arm member spacedly offset from said clamp;

whereby said at least one rigid arm member may be attached to an upper portion of said bag body with said pivot axis transverse to said central axis so that said bag body may be fixedly retained in a golf cart vehicle, of the kind adapted for receiving a golf club bag in a substantially vertical orientation, in a mounted position different than said adapted for substantially vertical orientation, with said upper portion offset from said substantially vertical orientation and said golf club bag being angled away from the interior of said golf cart vehicle, said upper portion being positioned closer to ground level.

15. A golf club bag accessory for mounting on a golf club bag having an elongated hollow bag body, a central longitudinal axis and a base enclosing a lower end of said bag body, said golf club bag accessory comprising:

at least one elongated rigid arm member attached to clamping means for securely mounting said golf bag accessory to said bag body; and, securing means on a portion of said at least one arm members spacedly offset from said clamping means, said securing means being adapted for engaging a rigid mounting bar on a golf cart vehicle, of the kind adapted for receiving a golf club bag in a substantially vertical orientation;

whereby said at least one rigid arm member is attachable to an upper portion of said bag body so that said bag body may be fixedly retained in said golf cart vehicle with said upper portion of said bag body spaced apart from said rigid mounting bar, said bag body being angled away from said adapted for substantially vertical orientation provided by said rigid mounting bar and said upper portion being positioned closer to ground level.

16. A golf club bag accessory for mounting on a golf club bag having an elongated hollow bag body, a central longitudinal axis and a base enclosing a lower end of said bag body, said golf club bag accessory comprising:

an auxiliary base adapted for attachment to said golf club bag at said lower end;

a rigid L shaped member having first and second portions;

said first portion providing means for attaching said auxiliary base to said golf club bag; and, said second portion formed approximately perpendicular to said central longitudinal axis, defining a support surface for maintaining said bag body in a tilted away position with said central longitudinal axis angled away the interior of a golf cart vehicle otherwise adapted to hold said bag body in a substantially vertical orientation, an upper portion of said bag body being spaced away said interior and closer to ground level than otherwise provided by said adapted for substantially vertical orientation.

* * * * *